US011313595B2

(12) United States Patent
Takenaka et al.

(10) Patent No.: US 11,313,595 B2
(45) Date of Patent: Apr. 26, 2022

(54) AIR-CONDITIONING SYSTEM AND METHOD OF SEALING HEAT MEDIUM

(71) Applicant: Mitsubishi Electric Corporation, Tokyo (JP)

(72) Inventors: Naofumi Takenaka, Tokyo (JP); Yuji Motomura, Tokyo (JP); Osamu Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 148 days.

(21) Appl. No.: 16/617,102

(22) PCT Filed: Jul. 27, 2017

(86) PCT No.: PCT/JP2017/027142

§ 371 (c)(1),
(2) Date: Nov. 26, 2019

(87) PCT Pub. No.: WO2019/021406

PCT Pub. Date: Jan. 31, 2019

(65) Prior Publication Data

US 2020/0256589 A1 Aug. 13, 2020

(51) Int. Cl.
*F25B 13/00* (2006.01)

(52) U.S. Cl.
CPC ..... *F25B 13/00* (2013.01); *F25B 2313/003* (2013.01); *F25B 2700/1931* (2013.01);
(Continued)

(58) Field of Classification Search
CPC ..... F25B 13/00; F25B 2313/003; F25B 2700/1931; F25B 2700/1933;
(Continued)

(56) References Cited

U.S. PATENT DOCUMENTS 5,718,119 A * 2/1998 Wakita ..... F25B 45/00 62/303
2013/0205818 A1* 8/2013 Morimoto ..... F24F 1/00077 62/186
2013/0269379 A1* 10/2013 Ue ..... F25B 25/005 62/160

FOREIGN PATENT DOCUMENTS

EP 2 463 594 A1 6/2012
JP H0370953 A * 3/1991
(Continued)

OTHER PUBLICATIONS

Yamamoto, Refrigerant Filling in System for Refrigeration Cycle, Mar. 26, 1991, JPH0370953A, Whole Document (Year: 1991).*
(Continued)

*Primary Examiner* — Larry L Furdge
(74) *Attorney, Agent, or Firm* — Posz Law Group, PLC

(57) ABSTRACT

An air-conditioning system includes a heat source side refrigerant circuit in which a heat source side heat exchanger is provided, a load side heat medium circuit in which a load side heat exchanger is provided, an intermediate heat exchanger, and a heat medium sealing. The heat medium sealing mechanism includes a supply port through which the heat medium and gas flow, the gas being more soluble in the heat medium than air, a discharge port through which the gas pushed by the heat medium is discharged, and a flow straightener that is connected to the load side heat medium circuit in such a manner that, when the gas is supplied, the gas flows from the supply port to the discharge port, and when the heat medium is supplied, the heat medium flows from the supply port to the discharge port.

15 Claims, 8 Drawing Sheets

(52) U.S. Cl.
CPC ..... *F25B 2700/1933* (2013.01); *F25B 2700/2106* (2013.01); *F25B 2700/21151* (2013.01); *F25B 2700/21152* (2013.01)

(58) Field of Classification Search
CPC .... F25B 2700/2106; F25B 2700/21151; F25B 2700/21152; F25B 2313/0314; F25B 2313/0315
See application file for complete search history.

(56) References Cited

FOREIGN PATENT DOCUMENTS

| | | | |
|---|---|---|---|
| JP | H05-141671 | A | 6/1993 |
| JP | H06-147536 | A | 5/1994 |
| WO | 2011/083519 | A1 | 7/2011 |
| WO | WO2016071978 | A1 * | 5/2016 |

OTHER PUBLICATIONS

Motomura, Air Conditioning Device, May 13, 2016, WO2016071978A1, Whole Document (Year: 2016).*

* cited by examiner

AIR-CONDITIONING SYSTEM AND METHOD OF SEALING HEAT MEDIUM

CROSS REFERENCE TO RELATED APPLICATION

This application is a U.S. national stage application of International Application No. PCT/JP2017/027142, filed on Jul. 27, 2017, the contents of which are incorporated herein by reference.

TECHNICAL FIELD

The present invention relates to an air-conditioning system in which a heat medium transfers heating energy and cooling energy generated in a refrigerant circuit to a use side device, and a method of sealing the heat medium.

BACKGROUND

There has been a growing demand for a refrigerating and air-conditioning apparatus that is used not only for air conditioning inside a building but also for temperature control in the production line of products. For example, a large scale commercial facility or other facilities is equipped with a water air-conditioning system and hot water supply system in which cold water generated by a refrigeration cycle apparatus such as a chiller and hot water generated by a boiler are delivered into each room, and the room is cooled or heated by an air handling unit, a fan coil unit, or other units, and the hot water is supplied. Alternatively, to maintain constant quality of the product, the water air-conditioning system is employed for the temperature control of the production line. Furthermore, also in homes, the heating energy and cooling energy generated in the refrigerant circuit are used not only for normal cooling and heating but also for floor heating and floor cooling through a panel heater.

In a direct expansion system that causes refrigerant to circulate between a heat source unit and a use side heat exchanger, a procedure in which the refrigerant is injected into a pipe after air in the pipe is evacuated during the pipe construction is typically performed. Another system contrasted with the direct expansion system is an indirect system. The water air-conditioning system and hot water supply system that cause heat medium such as water and antifreeze to circulate in the water air-conditioning system and hot water supply system correspond to the indirect system. In the indirect system, a procedure in which after the pipe construction, water supplied from tap water, or other liquid is injected into a pipe without evacuating air in the pipe is typically performed, for example. In this procedure, the pipe is not evacuated when the water is sealed in the pipe, resulting that an air mass may remain in the pipe because of the influence of the density and surface tension of the air.

As the air mass is poorly water soluble, the air mass serves as a heat transfer flow path resistance. When the air mass remains in the pipe for a long time, oxygen in the air mass causes corrosion of the pipe in some cases. Furthermore, the air mass also leads to a failure of the pump. As an example of the pipe in which the air mass tends to remain, an inverted U-shaped pipe is known. The inverted U-shaped pipe includes two pipes arranged in parallel in a direction perpendicular to the ground and one horizontal pipe connecting between upper openings of these two pipes. Hereinafter, the inverted U-shaped pipe is referred to as a bent pipe.

In the indirect system, an example of a method that causes an air mass not to remain in a pipe is disclosed in Patent Literature 1. Patent Literature 1 discloses that an air purge valve is provided on a pipe portion in the bent pipe, the pipe portion being higher in height than is the surrounding pipe portion, so that the air can be purged from the valve when the water is sealed in the pipe. Although not directed to a method of discharging an air mass from the pipe, Patent Literature 2 discloses a method of discharging foreign substances from the pipe. Patent Literature 2 discloses that the water is pressurized to push out the foreign substances from a circulation hot water circuit. On the other hand, in Patent Literature 3, there is proposed a method of evacuating the pipe in the same manner as in the direct expansion system. As a work for sealing the water in the pipe is similar to a work for filling the refrigerant, it is easy for an operator to perform the method disclosed in Patent Literature 3.

PATENT LITERATURE

Patent Literature 1: International Publication No. WO 2011/083519

Patent Literature 2: Japanese Unexamined Patent Application Publication No. 5-141671

Patent Literature 3: Japanese Unexamined Patent Application Publication No. 6-147536

In the method disclosed in Patent Literature 1, it is necessary to consider the installation position of the air purge valve during the pipe design. When the number of bent pipes in which a portion of pipe is higher in height than is the surrounding pipe is large, it is necessary to provide a corresponding number of air purge valves to the number of bent pipes.

In the method disclosed in Patent Literature 2, the air is pushed out of the pipe under the pressure of water, the force of a pump, or other forces, resulting that much time is required to seal the water in the pipe and a large amount of water is required. Furthermore, it is difficult to push out all air in the pipe, resulting that the air mass may remain in the pipe. The field experience of the operator is therefore required to determine how much water pressure is to be applied and how much water is sealed to purge the air. As a result, whether the air mass remains in the pipe will depend on the discretion of the operator.

On the other hand, in the case of water pipes, most of devices such as a flow control valve are made of resin, in terms of pressure resistance, weight and production cost. For this reason, when air in the pipes is evacuated, these devices may be warped because of the negative pressure. In addition, a joint such as a quick fastener is used for a connection portion to the water pipe, but the joint used for a water pipe is weak against the negative pressure. Furthermore, in some cases, a part of water that has entered the inside of the pipes in the negative pressure state is frozen to ice, which may cause damage to the pipes. A method of evacuating the air cannot be employed for the water pipes using pipes and pipe devices that are made of resin.

SUMMARY

The present invention has been made to solve the above-described problems, and an object of the present invention is to provide an air-conditioning system in which a remaining amount of air in a load side heat medium circuit is reduced to increase the heat transfer efficiency, and a method of sealing a heat medium.

An air-conditioning system according to an embodiment of the present invention includes a heat source side refrigerant circuit in which a heat source side heat exchanger is provided, a load side heat medium circuit in which a load side heat exchanger is provided, an intermediate heat exchanger configured to exchange heat between the heat source side refrigerant circuit and the load side heat medium circuit, and a heat medium sealing mechanism that is provided in the load side heat medium circuit and at which a heat medium is supplied to the load side heat medium circuit. The heat medium sealing mechanism includes a supply port that is connected to the load side heat medium circuit and through which the heat medium and gas flow, the gas being more soluble in the heat medium than is air, a discharge port that is connected to the load side heat medium circuit and through which the gas pushed by the heat medium is discharged, and a flow straightener that is connected to the load side heat medium circuit in such a manner that, when the gas is supplied, the gas flows from the supply port to the discharge port, and when the heat medium is supplied, the heat medium flows from the supply port to the discharge port.

A method of sealing a heat medium according to an embodiment of the present invention is a method of sealing the heat medium in a load side heat medium circuit in an air-conditioning system including a heat source side refrigerant circuit including a heat source side heat exchanger; the load side heat medium circuit including a load side heat exchanger, a supply port, a discharge port, and a flow straightener provided between the supply port and the discharge port; and an intermediate heat exchanger configured to exchange heat between the heat source side refrigerant circuit and the load side heat medium circuit, the method including a first replacement step in which gas that is more soluble in the heat medium than is air is supplied from the supply port to the load side heat medium circuit and discharged from the discharge port until the gas is sealed in the load side heat medium circuit, and a second replacement step in which, when the gas is sealed in the load side heat medium circuit, the heat medium is supplied from the supply port to the load side heat medium circuit until the heat medium is sealed in the load side heat medium circuit.

According to an embodiment of the present invention, before the heat medium is sealed in the load side heat medium circuit, the gas that is more soluble in the heat medium than is air is sealed in the pipe while the gas is pushing out the air, whereby a large mass such as an air mass can be prevented from being formed in the pipe even when the sealed gas remains in the pipe. As a result, the flow path resistance due to the gas mass is reduced, and the heat transfer efficiency of the load side heat medium circuit is increased.

DETAILED DESCRIPTION

Embodiments of the present invention will be described with reference to drawings.

Embodiment 1

Figure 1:
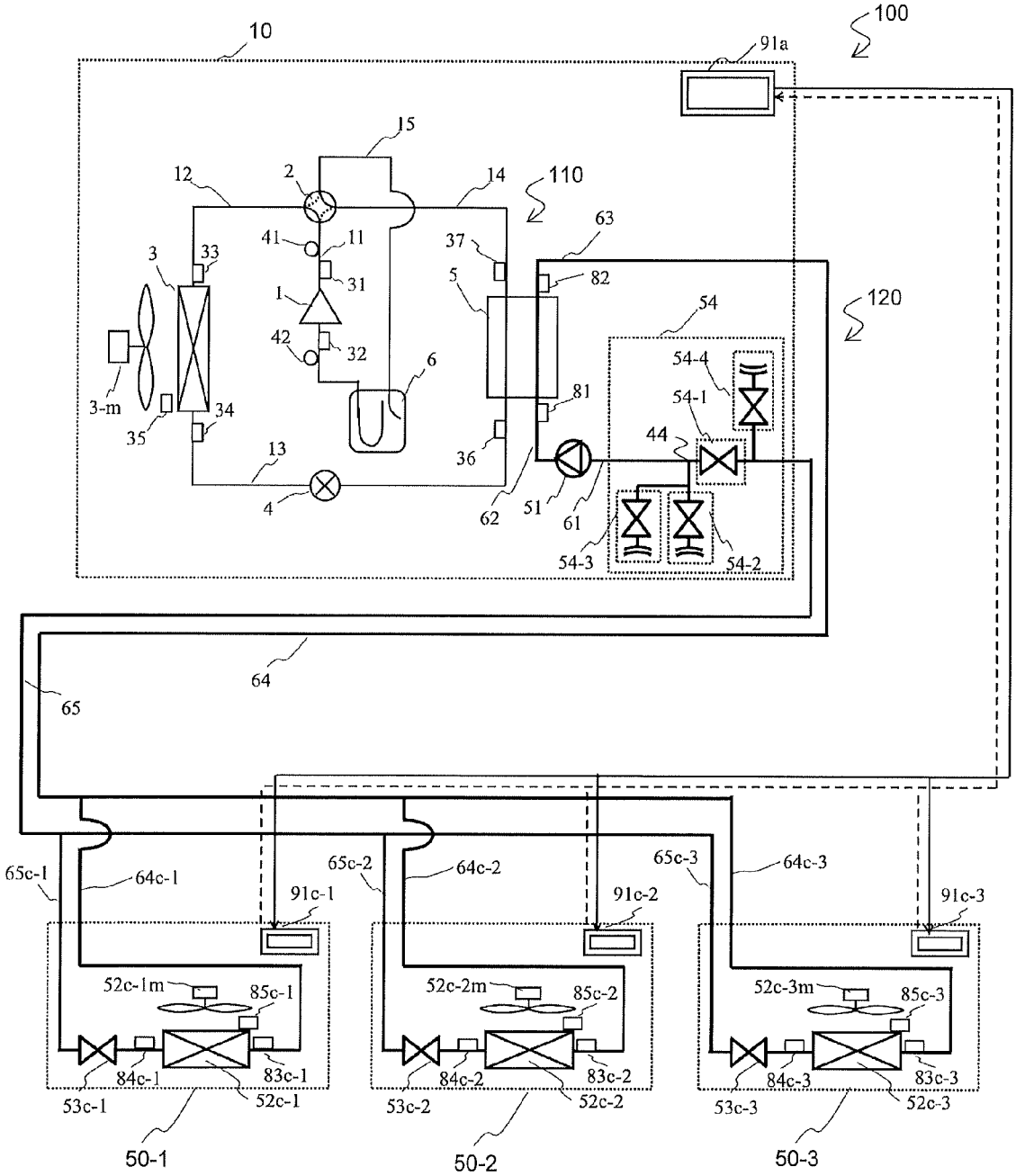
FIG. 1 is a refrigerant circuit diagram illustrating an exemplary configuration of an air-conditioning system according to Embodiment 1 of the present invention.
Figure 2:
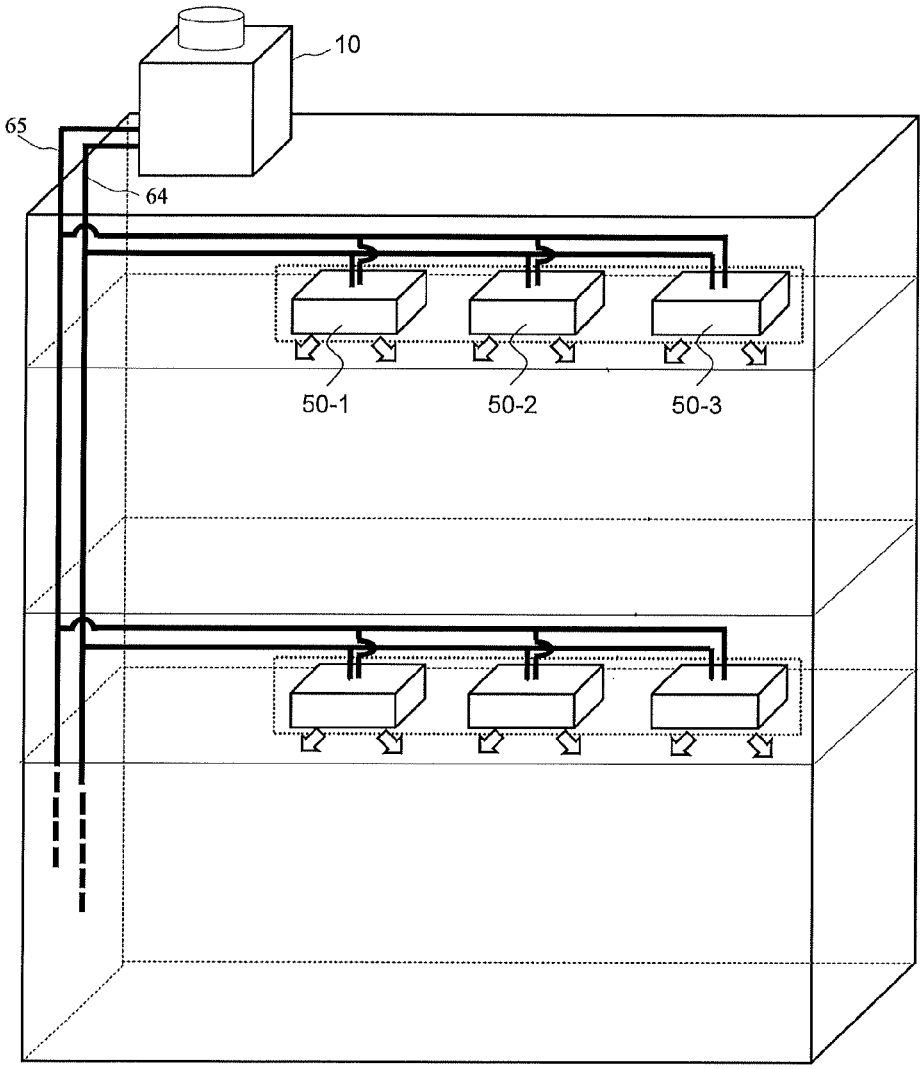
FIG. 2 is a diagram illustrating exemplary installation of the air-conditioning system illustrated in FIG. 1.

An overview of a configuration of an air-conditioning system of Embodiment 1 will be described. FIG. 1 is a refrigerant circuit diagram illustrating an exemplary configuration of an air-conditioning system according to Embodiment 1 of the present invention. FIG. 2 is a diagram illustrating exemplary installation of the air-conditioning system illustrated in FIG. 1. The description in Embodiment 1 is made with a case where an air-conditioning system 100 is a refrigerating and air-conditioning apparatus that performs a primary side cycle in which the cooling energy and heating energy are generated using the refrigeration cycle and a secondary side cycle in which the cooling energy and heating energy generated in the primary side cycle are transferred.

As illustrated in FIG. 1, the air-conditioning system 100 includes a heat source unit 10, and a plurality of load side units 50-1 to 50-3. The load side units 50-1 to 50-3 are connected to the heat source unit 10 in parallel. In the exemplary installation illustrated in FIG. 2, the heat source unit 10 is installed on a building rooftop, and the load side units 50-1 to 50-3 are installed on a ceiling of a room that is an air-conditioned space in the building.

In Embodiment 1, as illustrated in FIG. 1, a configuration in which three load side units are connected to one heat source unit 10 is described, however, the number of load side units connected to the heat source unit 10 is not limited to three. FIG. 2 illustrates a configuration in which in addition to the load side units 50-1 to 50-3, three load side units are connected to the heat source unit 10. Alternatively, the air-conditioning system 100 may have a configuration in which two or more load side units are connected to two or more heat source units.

As illustrated in FIG. 1, the load side units 50-1 to 50-3 are connected to the heat source unit 10 through a supply pipe 64 and a return pipe 65. The supply pipe 64 is used to supply the heat medium from the heat source unit 10 to the load side units 50-1 to 50-3. The return pipe 65 is used to return the heat medium from the load side units 50-1 to 50-3 to the heat source unit 10.

The supply pipe 64 branches to first connecting pipes 64*c*-1 to 64*c*-3 inside the building. The first connecting pipes 64*c*-1 to 64*c*-3 are connected to the load side units 50-1 to 50-3, respectively. Second connecting pipes 65*c*-1 to 65*c*-3 are connected to the load side units 50-1 to 50-3, respectively. The second connecting pipes 65*c*-1 to 65*c*-3 are joined into the return pipe 65.

The air-conditioning system 100 includes a heat source side refrigerant circuit 110 in which the primary side cycle is performed, and a load side heat medium circuit 120 in which a secondary side cycle is performed. The heat source side refrigerant circuit 110 includes a compressor 1, a heat source side heat exchanger 3, an expansion device 4, an intermediate heat exchanger 5, and a liquid storage mechanism 6 that are connected through pipes. Load side heat exchangers 52*c*-1 to 52*c*-3 are provided in the load side units 50-1 to 50-3, respectively. The load side heat medium circuit 120 has a configuration in which a pump 51, the intermediate heat exchanger 5, and the load side heat exchanger 52*c*-1 that are connected through pipes. In an exemplary configuration illustrated in FIG. 1, the load side heat medium circuit 120 is also formed in a circuit in which the pump 51, the intermediate heat exchanger 5, and the load side heat exchanger 52*c*-2 are connected through pipes. Furthermore, the load side heat medium circuit 120 is also formed in a circuit in which the pump 51, the intermediate heat exchanger 5, and the load side heat exchanger 52*c*-3 are connected through pipes. The air-conditioning system 100 of Embodiment 1 includes a heat medium sealing mechanism 54 for sealing the heat medium in the load side heat medium circuit 120.

The air-conditioning system 100 has a configuration in which the primary side cycle is performed in the heat source side refrigerant circuit 110 of the heat source unit 10, and the cooling energy and heating energy generated in the primary cycle are transferred to the load side units 50-1 to 50-3 through the supply pipe 64 and the return pipe 65.

Examples of refrigerant used in the primary side cycle include a fluorocarbon refrigerant, an HFO refrigerant, a $CO_2$ refrigerant, an HC refrigerant, and an ammonia refrigerant. Examples of the fluorocarbon refrigerant include R32, R125, and R134a that are HFC-based refrigerants, and mixtures of these refrigerants such as R410A, R407c, and R404A. Examples of the HFO refrigerant include HFO-1234yf, HFO-1234ze(E), HFO-1234ze(Z), and HFO-1123. Examples of the HC refrigerant include a propane refrigerant and an isobutane refrigerant.

The refrigerant used in the primary side cycle may be a mixture of a plurality of refrigerants as described above. Examples of the mixed refrigerant include not only mixture of the HFC-based refrigerants but also refrigerant that is applied to a vapor compression heat pump. The mixed refrigerant may be a mixture of R32, HFO-1234yf, and R125.

Examples of the heat medium used in the secondary side cycle include water and antifreeze. The antifreeze is a liquid obtained by mixing ethylene glycol, propylene glycol, methanol, and other substance in water.

Note that in Embodiment 1, a case is described where the air-conditioning system is a refrigerating and air-conditioning apparatus, however, the air-conditioning system is only required to be a device requiring the work of sealing the heat medium in the load side heat medium circuit 120, and therefore the air-conditioning system is not limited to the refrigerating and air-conditioning apparatus. In addition, the heat source side refrigerant circuit 110 is not limited to a circuit that performs a refrigeration cycle. A heat source in the heat source side refrigerant circuit 110 may be a heat source device such as a boiler that burns fuel to generate the heating energy. In addition, the relationship of sizes of the components in the drawings to be referred to in the following description may differ from the relationship of actual sizes. In Embodiment 1, a case is described where the heating energy and cooling energy generated in the primary side cycle are used for air conditioning of an air-conditioned space, however, the heating energy may be applied to the hot water supply and the use of hot water for floor heating, and the cooling energy may be applied to the use of cold water for floor cooling.

FIG. 1 illustrates a configuration in which a plurality of load side units 50-1 to 50-3 are connected to the heat source unit 10 in parallel, however, the manner of connecting the load side units 50-1 to 50-3 may be changed in accordance with the load design of the air-conditioned space. The load side units 50-1 to 50-3 may be arranged along the pipes of the load side heat medium circuit 120 and connected in series. Usually, when the temperature conditions of the load side units 50-1 to 50-3 are significantly different from one another, the load side units 50-1 to 50-3 are installed in parallel, as illustrated in FIG. 1 and FIG. 2. Furthermore, capacities of the air-conditioned space of the respective load side units may be the same or different from one another.

Next, the configurations of the heat source unit 10 and the load side units 50-1 to 50-3 will be described in detail.

[Configuration of Heat Source Unit 10]

The heat source unit 10 is usually disposed in a space outside of a structure such as a building, and configured to supply the cooling energy and the heating energy to the load side units 50-1 to 50-3. Examples of the space outside of the structure include a rooftop. FIG. 2 illustrates a case where the heat source unit 10 is installed on a building rooftop. However, a place where the heat source unit 10 is installed is not limited to the outdoors. The heat source unit 10 may be installed in a space above a ceiling or an enclosed space such as a machine room provided with a ventilation hole. As long as waste heat can be exhausted out of the structure through an exhaust duct, the heat source unit 10 may be installed inside the structure. When a water-cooled heat source side heat exchanger is used, the heat source unit 10 may be installed inside the structure. As long as the heat source unit 10 can exchange heat with outside air, the heat source unit 10 may be installed at any place.

The heat source unit 10 includes the compressor 1, a four-way valve 2, the heat source side heat exchanger 3, the expansion device 4, the intermediate heat exchanger 5, and the liquid storage mechanism 6. The heat source unit 10 is provided with an outdoor fan 3-*m* that supplies the outside air to the heat source side heat exchanger 3. Furthermore, the heat source unit 10 includes the pump 51 and the heat medium sealing mechanism 54 that are provided in the load side heat medium circuit 120. The heat source unit 10 is provided with a controller 91*a* that controls the primary side cycle and the secondary side cycle.

Among components provided in the load side heat medium circuit 120, the pump 51, the intermediate heat exchanger 5, the heat medium sealing mechanism 54, and pipes 61, 62, and 63 are provided in the heat source unit 10. The pipe 61 is connected to the load side units 50-1 to 50-3 through the return pipe 65. The pipe 62 connects between the pump 51 and the intermediate heat exchanger 5. The pipe 63 is connected to the load side units 50-1 to 50-3 through the supply pipe 64. The heating energy and cooling energy generated in the primary side cycle are transferred to the load side units 50-1 to 50-3 through the intermediate heat exchanger 5, the supply pipe 64, and the return pipe 65.

Here, among the components provided in the load side heat medium circuit 120, the components provided in the heat source unit 10 will be described. Among the components provided in the load side heat medium circuit 120, the components provided in the load side units 50-1 to 50-3 will be described later.

A refrigerant discharge port of the compressor 1 is connected to the four-way valve 2 through a discharge pipe 11. A refrigerant suction port of the compressor 1 is connected to the liquid storage mechanism 6 and the four-way valve 2 through a suction pipe 15. The heat source side heat exchanger 3 is connected to the four-way valve 2 through a gas side pipe 12. The heat source side heat exchanger 3 is connected to the expansion device 4 and the intermediate heat exchanger 5 through a liquid side pipe 13. The intermediate heat exchanger 5 is connected to the four-way valve 2 through a gas side pipe 14. The intermediate heat exchanger 5 is connected to the pipes 62 and 63.

Figure 3:
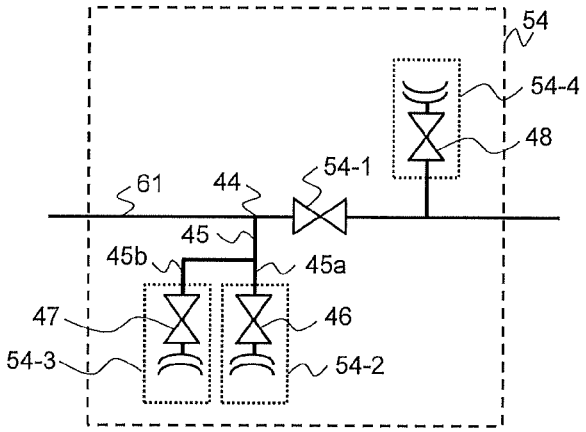
FIG. 3 is an enlarged view illustrating an exemplary configuration of a heat medium sealing mechanism illustrated in FIG. 1.

A configuration of the heat medium sealing mechanism 54 illustrated in FIG. 1 will be described. FIG. 3 is an enlarged view illustrating an exemplary configuration of the heat medium sealing mechanism illustrated in FIG. 1. As illustrated in FIG. 3, the heat medium sealing mechanism 54 includes a supply port 44, a discharge port 54-4, and an opening-and-closing valve 54-1 provided between the supply port 44 and the discharge port 54-4. The supply port 44, the discharge port 54-4, and the opening-and-closing valve 54-1 are provided in the pipe 61. The pipe 45 is connected to the supply port 44 of the pipe 61, and the pipe 45 branches to a gas pipe 45*a* and a heat medium pipe 45*b*. A gas supply port 54-2 is provided in the gas pipe 45*a*, and a heat medium supply port 54-3 is provided in the heat medium pipe 45*b*.

The gas supply port 54-2 is a supply port of gas X with which air in the load side heat medium circuit 120 is replaced. The heat medium supply port 54-3 is a supply port through which the heat medium flows into the load side heat medium circuit 120. A gas valve 46 is provided in the gas pipe 45*a*. A heat medium valve 47 is provided in the heat medium pipe 45*b*. The discharge port 54-4 discharges air and the gas X from the load side heat medium circuit 120. A discharge valve 48 is provided in a pipe leading to the discharge port 54-4. Each of the opening-and-closing valve 54-1, the gas valve 46, the heat medium valve 47, and the discharge valve 48 is a two-way valve.

The heat medium circulating in the load side heat medium circuit 120 is, for example, water or antifreeze. When the major constituent of the heat medium is water, the gas X is gas that is more soluble in water than is air. That is, an amount of the gas X that dissolves in water is larger than that of air that dissolves in water. The gas X will be described later in detail. The following description will be made with a case where the heat medium to be sealed in the load side heat medium circuit 120 is water.

The opening-and-closing valve 54-1 is used as a backflow prevention device that prevents the gas X and water supplied from the supply port 44 from flowing out of the discharge port 54-4 without flowing through the load side heat medium circuit 120. The opening-and-closing valve 54-1 is used to allow unidirectional flow of the gas X and water in the work of sealing the heat medium, which will be described later.

In addition, the heat source unit 10 is provided with thermometers 31 to 37, 81, and 82, and pressure gauges 41 and 42. The thermometer 31 is provided in the discharge pipe 11 and to the refrigerant discharge port of the compressor 1. The thermometer 31 measures the discharge temperature of the refrigerant out of the compressor 1. The thermometer 32 is provided in the suction pipe 15 and to the refrigerant suction port of the compressor 1. The thermometer 32 measures the suction temperature of the refrigerant into the compressor 1.

The thermometer 33 is provided in the gas side pipe 12 of the heat source side heat exchanger 3. The thermometer 33 measures the temperature of the refrigerant in the gas side portion of the heat source side heat exchanger 3. The thermometer 34 is provided in the liquid side pipe 13 of the heat source side heat exchanger 3. The thermometer 34 measures the temperature of the refrigerant in the liquid side portion of the heat source side heat exchanger 3. The thermometer 35 is provided to the heat source unit 10. The thermometer 35 measures the temperature of the outside air suctioned by the outdoor fan 3-*m*.

The thermometer 36 is provided in the liquid side pipe 13 of the intermediate heat exchanger 5. The thermometer 36 measures the temperature of the refrigerant in the liquid side portion of the intermediate heat exchanger 5. The thermometer 37 is provided in the gas side pipe 14 of the intermediate heat exchanger 5. The thermometer 37 measures the temperature of the refrigerant in the gas side portion of the intermediate heat exchanger 5. The pressure gauge 41 is provided in the discharge pipe 11 and to the refrigerant discharge port of the compressor 1. The pressure gauge 41 measures the discharge pressure of the refrigerant of the compressor 1. The pressure gauge 42 is provided in the suction pipe 15 and to the refrigerant suction port of the compressor 1. The pressure gauge 42 measures the suction pressure of the refrigerant of the compressor 1.

The thermometer 81 is provided in the pipe 62 of the intermediate heat exchanger 5. The thermometer 81 measures the temperature of water flowing into the intermediate heat exchanger 5. The thermometer 82 is provided in the pipe 63 of the intermediate heat exchanger 5. The thermometer 82 measures the temperature of water flowing out of the intermediate heat exchanger 5.

Figure 4:
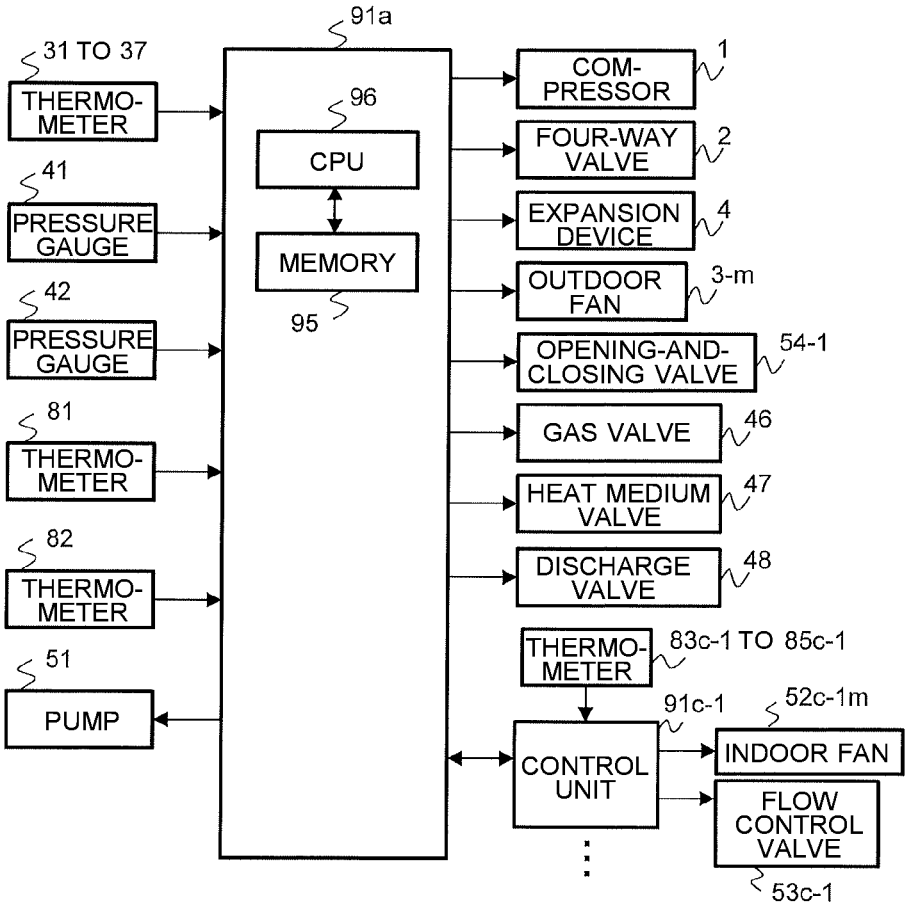
FIG. 4 is a block diagram illustrating an exemplary configuration of a controller illustrated in FIG. 1.

FIG. 4 is a block diagram illustrating an exemplary configuration of the controller illustrated in FIG. 1. The controller 91*a* includes a memory 95 that stores a program, and a central processing unit (CPU) 96 that executes processing in accordance with the program. The controller 91*a* is connected to the thermometers 31 to 37, 81, and 82 by signal lines. The controller 91*a* is connected to the pressure gauges 41 and 42 by signal lines. The controller 91*a* is connected to the compressor 1, the outdoor fan 3-*m*, the four-way valve 2, and the pump 51 by signal lines. The controller 91*a* is connected to the opening-and-closing valve 54-1, the gas valve 46, the heat medium valve 47, and the discharge valve 48 by signal lines. In FIG. 1, these signal lines are not illustrated.

As illustrated in FIG. 1, the controller 91*a* is connected to each of the control units 91*c*-1 to 91*c*-3 that are provided the respective load side units 50-1 to 50-3 by a signal line. In FIG. 4, the control units 91*c*-2 and 91*c*-3 are not illustrated.

The controller 91*a* controls a refrigeration cycle of the primary side cycle. When the controller 91*a* receives a request for a heating operation from the control units 91*c*-1 to 91*c*-3, the controller 91*a* causes the four-way valve 2 to connect the discharge pipe 11 to the gas side pipe 14 and connect the suction pipe 15 to the gas side pipe 12. Through this connection, the controller 91*a* causes the intermediate heat exchanger 5 to generate the heating energy. When the controller 91*a* receives a request for a cooling operation from the control units 91*c*-1 to 91*c*-3, the controller 91*a* causes the four-way valve 2 to connect the discharge pipe 11 to the gas side pipe 12 and connect the suction pipe 15 to the gas side pipe 14. Through this connection, the controller 91*a* causes the intermediate heat exchanger 5 to generate the cooling energy.

The controller 91*a* controls each actuator including the compressor 1 and the expansion device 4 on the basis of measured values obtained from the thermometers 31 to 37 and measured values obtained from the pressure gauges 41 and 42. More specifically, the controller 91*a* controls an operating frequency of the compressor 1 to adjust the capacity of the refrigeration cycle. Furthermore, the controller 91*a* controls the opening degree of the expansion device 4 to adjust the degree of superheat and the degree of subcool of the heat source side heat exchanger 3 and the intermediate heat exchanger 5.

When an instruction to seal water in the load side heat medium circuit 120 is input after the pipe construction, the controller 91*a* controls the heat medium sealing mechanism 54. A specific example of control during the heat medium sealing will be described later.

[Configurations of Load Side Units 50-1 to 50-3]

Each of the load side unit 50-1 to 50-3 is installed at a position where it can supply conditioned air into an air-conditioned space such as an inside of a room. When the cooling energy is supplied from the heat source unit 10, each of the load side units 50-1 to 50-3 supplies cooled air into the air-conditioned space. When the heating energy is supplied from the heat source unit 10, each of the load side units 50-1 to 50-3 supplies heated air into the air-conditioned space. As the load side units 50-1 to 50-3 have the same configuration, the configuration of the load side unit 50-1 will be described below in detail, and the description of the configurations of the load side unit 50-2 and the load side unit 50-3 are omitted. Each of the control units 91*c*-1 to 91*c*-3 includes a CPU and a memory (not illustrated), as in the case of the controller 91*a*.

The load side unit 50-1 includes the load side heat exchanger 52*c*-1, an indoor fan 52*c*-1*m*, and the control unit 91*c*-1. A flow control valve 53*c*-1 is provided to a water inflow port of the load side heat exchanger 52*c*-1. The flow control valve 53*c*-1 adjusts the flow rate of water flowing into the load side heat exchanger 52*c*-1. The indoor fan 52*c*-1*m* that suctions air from the air-conditioned space and supplies the air to the load side heat exchanger 52*c*-1 is provided in the load side unit 50-1. A thermometer 84*c*-1 that measures the temperature of water is provided to the water inflow port of the load side heat exchanger 52*c*-1. A thermometer 83*c*-1 that measures the temperature of water is provided to a water outflow port of the load side heat exchanger 52*c*-1. A thermometer 85*c*-1 that measures the temperature of air in the air-conditioned space is provided in the load side unit 50-1.

The control unit 91*c*-1 is connected to the indoor fan 52*c*-1*m*, the flow control valve 53*c*-1, the thermometers 83*c*-1, 84*c*-1, and 85*c*-1 by signal lines. When an indication of the operation condition is input from a user, the control unit 91*c*-1 transmits the information on the operation condition to the controller 91*a*. The control unit 91*c*-1 controls the rotation frequency of the indoor fan 52*c*-1*m* and the opening degree of the flow control valve 53*c*-1 on the basis of the set temperature and the set humidity, and the measured values obtained from the thermometers 83*c*-1, 84*c*-1, and 85*c*-1.

Next, the operation of the air-conditioning system 100 of Embodiment 1 will be described. Firstly, a case will be described where the controller 91*a* performs the heating operation in the primary side cycle.

[Heating Operation]

When the controller 91*a* receives a request for the heating operation from the control units 91*c*-1 to 91*c*-3, the controller 91*a* causes the four-way valve 2 to connect the discharge pipe 11 to the gas side pipe 14 and connect the suction pipe 15 to the gas side pipe 12. The high-temperature and high-pressure refrigerant discharged from the compressor 1 flows into the intermediate heat exchanger 5. The intermediate heat exchanger 5 is used as a condenser. In the intermediate heat exchanger 5, the high-temperature and high-pressure refrigerant is subjected to heat exchange with water circulating through the load side heat medium circuit 120. In the intermediate heat exchanger 5, the water becomes hot water by exchanging heat with the refrigerant. The hot water is delivered to the load side units 50-1 to 50-3 through the pump 51. When the hot water arrives at the load side heat exchangers 52*c*-1 to 52*c*-3, the hot water is subjected to heat exchange with indoor air supplied by the indoor fans 52*c*-1*m* to 52*c*-3*m*, whereby the inside of the room is warmed.

[Cooling Operation]

Subsequently, a case will be described where the controller 91*a* performs the cooling operation in the primary side cycle. When the controller 91*a* receives a request for the cooling operation from the control units 91*c*-1 to 91*c*-3, the controller 91*a* causes the four-way valve 2 to connect the discharge pipe 11 to the gas side pipe 12 and connect the suction pipe 15 to the gas side pipe 14. The high-temperature and high-pressure refrigerant discharged from the compressor 1 flows into the heat source side heat exchanger 3. The heat source side heat exchanger 3 is used as a condenser. In the heat source side heat exchanger 3, the high-temperature and high-pressure refrigerant is subjected to heat exchange with outside air to become medium-temperature and high-pressure refrigerant. The medium-temperature and high-pressure refrigerant is depressurized by the expansion device 4 to become low-temperature and low-pressure refrigerant. The low-temperature and low-pressure refrigerant flows into the intermediate heat exchanger 5. The intermediate heat exchanger 5 is used as an evaporator. In the intermediate heat exchanger 5, the low-temperature and low-pressure refrigerant is subjected to heat exchange with water circulating through the load side heat medium circuit 120. In the intermediate heat exchanger 5, the water becomes cold water by exchanging heat with the refrigerant. The cold water is delivered to the load side units 50-1 to 50-3 through the pump 51. When the cold water arrives at the load side heat exchangers 52*c*-1 to 52*c*-3, the cold water is subjected to heat exchange with indoor air supplied by the indoor fans 52*c*-1*m* to 52*c*-3*m*, whereby the inside of the room is cooled.

Next, in the air-conditioning system 100 illustrated in FIG. 1, a procedure of sealing the water in the load side heat medium circuit 120 will be described.

The operation of the air-conditioning system 100 has been described briefly above, and a procedure for allowing the air-conditioning system 100 to be actually operated after the air-conditioning system 100 is installed will be described below. After the operator performs the installation of devices and the pipe construction for the air-conditioning system 100, a process of sealing the water in the load side heat medium circuit 120 is performed. Before a procedure of sealing the water in the load side heat medium circuit 120 is described, the installation of devices and the pipe construction for the air-conditioning system 100 will be described briefly.

[Installation of Devices and Pipe Construction]

The heat source unit 10 and the load side units 50-1 to 50-3 are arranged at respective places designed as an air-conditioning facility. Subsequently, the supply pipe 64 and the return pipe 65 are connected to the heat source unit 10. The first connecting pipes 64*c*-1 to 64*c*-3 are connected to the supply pipe 64. The second connecting pipes 65*c*-1 to 65*c*-3 are connected to the return pipe 65. Thus, the load side units 50-1 to 50-3 are connected to the heat source unit 10 in parallel.

[Procedure of Sealing Water]

Figure 5:
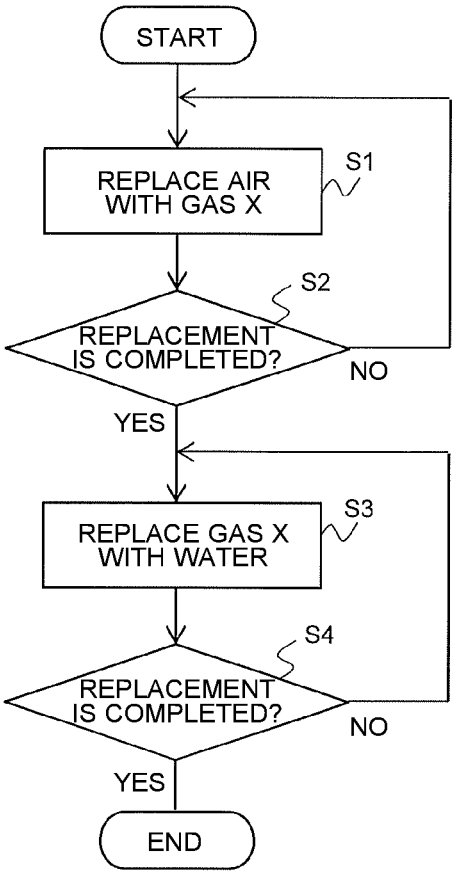
FIG. 5 is a flowchart illustrating a procedure of sealing water in a load side heat medium circuit in the air-conditioning system of Embodiment 1 of the present invention.

FIG. 5 is a flowchart illustrating a procedure of sealing the water in the load side heat medium circuit in the air-conditioning system of Embodiment 1 of the present invention. A cylinder (not illustrated) of the gas X is connected to the gas supply port 54-2. A supply pipe (not illustrated) for tap water is connected to the heat medium supply port 54-3. As an initial state, the gas valve 46, the heat medium valve 47, and the opening-and-closing valve 54-1 are in the closed state, and the discharge valve 48 is in the open state. The opening degree of each of the flow control valves 53*c*-1 to 53*c*-3 is set to full open. When an instruction to seal the water in the load side heat medium circuit 120 is input, the controller 91*a* executes processes in accordance with the procedure shown in FIG. 5.

The processes in steps S1 and S2 shown in FIG. 5 will be described. In step S1 shown in FIG. 5, the controller 91*a* controls the gas valve 46 and the opening-and-closing valve 54-1 to replace the air in the load side heat medium circuit 120 with the gas X. More specifically, the controller 91*a* switches the gas valve 46 from the closed state to the open state while maintaining the opening-and-closing valve 54-1 in the closed state, to supply the gas X to the load side heat medium circuit 120. The controller 91*a* determines whether the air in the load side heat medium circuit 120 has been replaced with the gas X (step S2). As a result of the determination, the controller 91*a* continues the supply of the gas X until a replacement process of replacing the air with the gas X is completed. When the replacement process of replacing the air with the gas X is completed, the process proceeds to next step S3. A step of replacing the air in the load side heat medium circuit 120 with the gas X is referred to as a first replacement step.

The gas X is gas that is more soluble in water than is air, in the gas state at ambient temperature from about 0 degrees C. to about 50 degrees C. and atmospheric pressure. The gas X is gas that has a Henry's constant smaller than that of the air. The gas X is, for example, gas such as carbon dioxide, ammonia, hydrogen chloride, chlorine, and hydrogen sulfide. When the operator recovers the gas X after circulation of the gas X, the gas X may leak to the atmosphere. It is therefore desirable that the gas X is gas, such as carbon dioxide, that not only is easily available but also has a small influence on the environment and is less harmful to the human body. A mechanism for recovering the air and the gas X, such as a recovery cylinder, may be provided to the discharge port 54-4. As long as the gas X is carbon dioxide, the discharge port 54-4 may be open to the atmospheric air.

Figure 6:
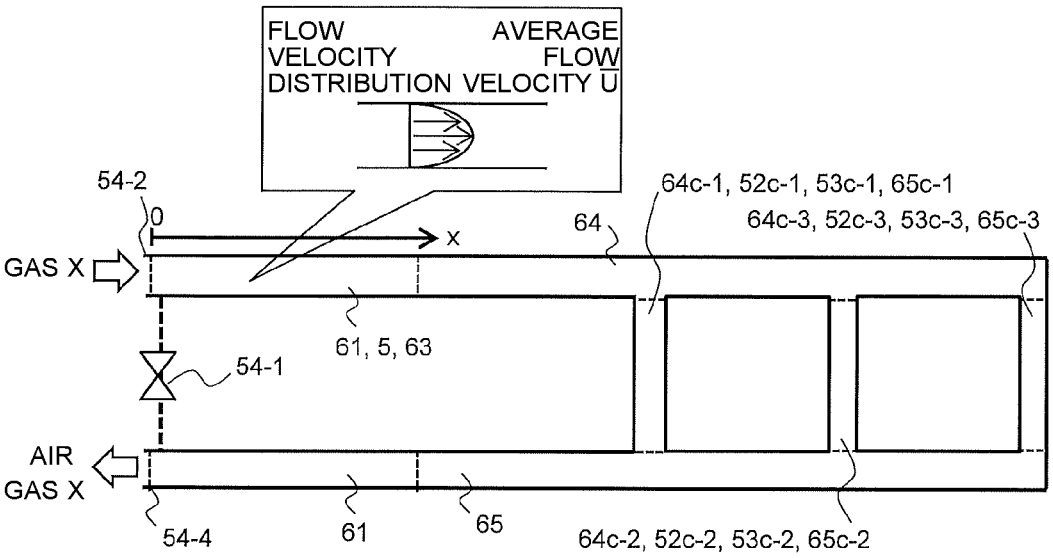
FIG. 6 is a diagram schematically illustrating the load side heat medium circuit illustrated in FIG. 1.
Figure 7:
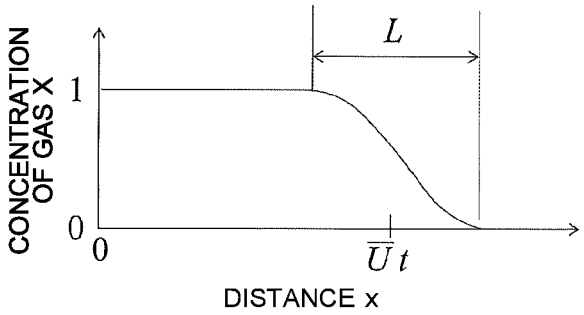
FIG. 7 is a graph showing a relationship between a distance from a supply port and a concentration of gas X in the load side heat medium circuit illustrated in FIG. 6.

A specific example of a method of determining the completion of the replacement process in step S2 will be described. FIG. 6 is a diagram schematically illustrating the load side heat medium circuit illustrated in FIG. 1. FIG. 6 illustrates the load side heat medium circuit 120 in a simple pipe configuration, and shows reference signs of pipes and components serving as flow path resistances. FIG. 7 is a graph showing the relationship between a distance from the supply port and a concentration of the gas X in the load side heat medium circuit illustrated in FIG. 6. In FIG. 7, the horizontal axis shows a distance x from the supply port 44, and the vertical axis shows a concentration of the gas X. The vertical axis in FIG. 7 represents the ratio of the gas X occupied per unit volume with 100% defined as 1.

As illustrated in FIG. 6, in the first replacement step, the controller 91*a* closes the opening-and-closing valve 54-1 so that the gas X flows in one direction, and then causes the gas X to flow into the load side heat medium circuit 120 through the gas supply port 54-2. In this manner, as illustrated in FIG. 6, the gas X flows from the gas supply port 54-2 through the pipes 61 and 62, the intermediate heat exchanger 5, the pipe 63, the supply pipe 64, the load side units 50-1 to 50-3, and the return pipe 65, and returns to the pipe 61.

When an average flow velocity of the gas X is represented as the mathematical formula 1 shown below, the concentration distribution after the elapse of a time t [sec] from the start of supply of the gas X is as shown in FIG. 7.

$\bar{U}$[m/sec] [Math. 1]

At this time, the flow control valves 53*c*-1 to 53*c*-3 are in the open state so that the gas X can push out the air in the second connecting pipes 65*c*-1 to 65*c*-3. When the opening degree of each of the flow control valves 53*c*-1 to 53*c*-3 is set to full open, the flow path resistance can be further reduced.

When the opening degree of each of the flow control valves 53*c*-1 to 53*c*-3 is set to full open, the flow path resistance of each flow control valve can be further reduced. However, the opening degree of each flow control valve is not limited to full open. The opening degrees of the flow control valves 53*c*-1 to 53*c*-3 may be each adjusted so that the periods of time from the start time of supply of the gas X until the gas X branches into each of the first connecting pipes 64*c*-1 to 64*c*-3 and is joined into the return pipe 65 are the same. Hereinafter, a specific example will be described.

When the operator performs the pipe construction of the load side heat medium circuit 120, the operator can recognize the length and cross-sectional area of each pipe of the supply pipe 64, the first connecting pipes 64*c*-1 to 64*c*-3, the return pipe 65, and the second connecting pipes 65*c*-1 to 65*c*-3. The relationship between the opening degree of each of the flow control valves 53*c*-1 to 53*c*-3 and the flow rate of the gas X is obtained beforehand from the specifications of these control valves. The operator inputs, to the controller 91*a*, the information about the length and cross-sectional area of each pipe and the information about the relationship between the opening degree of each of the flow control valves 53*c*-1 to 53*c*-3 and the flow rate of the gas X. The controller 91*a* calculates the flow path resistance of each pipe from the determined flow path resistance model, using the length and cross-sectional area of each pipe. The controller 91*a* sets the opening degree of each flow control valve on the basis of the flow path resistance of each pipe, and the relationship between the opening degree of each pipe and the flow rate of the gas X so that a difference in arrival time at which the gas X branching into each of the first connecting pipes 64*c*-1 to 64*c*-3 returns to the return pipe 65 is within a predetermined range.

Thus, each opening degree of the flow control valves 53*c*-1 to 53*c*-3 is adjusted so that the replacement time periods required to replace the air with the gas X in the respective branch pipes of the first connecting pipes 64*c*-1 to 64*c*-3 are the same, whereby the replacement process can be completed in a shorter time.

In addition, another method of determining the completion of the replacement process will be described. The turbulent flow diffusion and the molecular diffusion due to the flow of the gas X supplied and the flow of the air pushed out by the gas X form a mixed layer of the gas X and the air in the pipe of the load side heat medium circuit 120. The mixed layer will be described with reference to FIG. 7. In the mixed layer, the concentration of the gas X ranges from greater than 0 to less than 1. The length of the mixed layer is defined as L. It is only required that the controller 91*a* completes the first replacement step when the mixed layer is discharged from the discharge port 54-4. Hereinafter, a specific example will be described.

As the operator should recognize the volume of pipe of the load side heat medium circuit 120 during the pipe construction, the operator inputs the pipe volume of the load side heat medium circuit 120 to the controller 91*a*. The controller 91*a* obtains the replacement time period on the basis of the pipe volume of the load side heat medium circuit 120 and the inflow velocity of the gas X. At this time, the controller 91*a* sets, as the replacement time period, a time period of meeting the condition (inflow volume/(pipe volume+mixed layer volume))>1. The inflow volume of the gas X is represented by the expression: inflow volume=(cross-sectional area of gas supply port 54-2)×(inflow velocity)×(time). The mixed layer volume is represented by the expression: (length L)×(cross-sectional area of pipe).

With reference to FIG. 7, in the mixed layer, the concentration of the gas X is defined to range from greater than 0 to less than 1. The standard upper limit value is not limited to 1. It is ideal to completely replace the air in the pipe with the gas X, but the air is not completely replaced with the gas X in some cases. As long as the size of the air mass due to the remaining air causes no problem even when the air remains in a part of the pipe of the load side heat medium circuit 120, the standard upper limit value may be, for example, 0.99 in consideration of the working efficiency.

Figure 8:
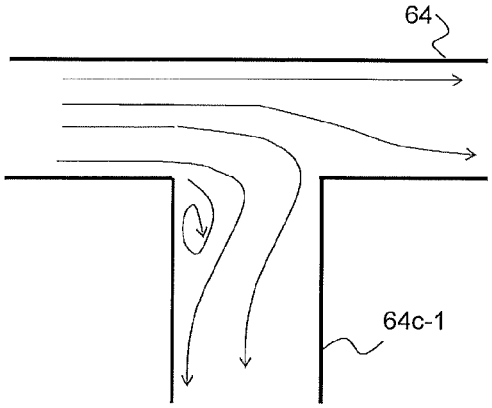
FIG. 8 is a diagram illustrating that a pipe shape disturbs the gas flow in a T-shaped pipe.
Figure 9:
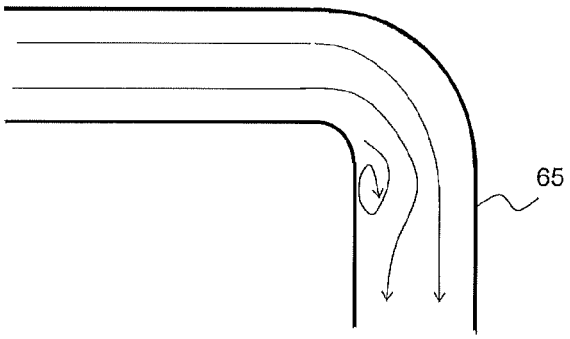
FIG. 9 is a diagram illustrating that a pipe shape disturbs the gas flow in an L-shaped pipe.

The ease of gas flow in the pipe is influenced not only by the flow path resistance but also by the shape of the pipe. FIG. 8 is a diagram illustrating that the pipe shape disturbs the gas flow in a T-shaped pipe. FIG. 9 is a diagram illustrating that the pipe shape disturbs the gas flow in an L-shaped pipe. FIG. 8 illustrates an enlarged view of a portion where the supply pipe 64 and the first connecting pipe 64*c*-1 are connected, as an example of the T-shaped pipe. FIG. 9 illustrates an enlarged view of a part of the return pipe 65, as an example of the L-shaped pipe.

As illustrated in FIG. 8, a part of gas flow along the supply pipe 64 branches into the first connecting pipe 64*c*-1. The gas flow branching into the first connecting pipe 64*c*-1 is subjected to a centrifugal force, and generates a secondary flow having a velocity component in a direction perpendicular to the pipe axis, whereby the gas in a region close to the side wall of the first connecting pipe 64*c*-1 is separated from the side wall. The separation vortex is generated at the branch point of the T-shaped pipe. On the other hand, the pressure of the gas located opposite to the separation vortex increases, and therefore a stagnation point is formed. These phenomena may also occur at the meeting point of the T-shaped pipe. Furthermore, the separation of the gas flow and the stagnation point of the gas flow also occur at a bent portion of the L-shaped pipe illustrated in FIG. 9, as described above with reference to FIG. 8.

As described above, the centrifugal force acting on the gas flow causes the secondary flow at the bent portion of the pipe, and the separation of the gas flow and the stagnation point of the gas flow occur. In this case, the flow velocity of the gas X is limited by the molecular diffusion at the stagnation point, whereby the length L of the mixed layer is increased. That is, the replacement time period required for the gas X to push out the air may be increased.

As an example of the countermeasures, the pressure of the gas X supplied from the gas supply port 54-2 may be varied so that the pressure does not remain constant. When the supply pressure of the gas X is varied, the flow of the gas X is varied, a position of the separation point is changed, and a position of the stagnation point is changed, whereby the air can be smoothly replaced with the gas X. Hereinafter, a specific example will be described.

A pressure regulator (not illustrated) is provided beforehand to the cylinder of the gas X. A pressure regulating valve of the pressure regulator is connected to the controller 91*a* by a signal line. The controller 91*a* starts supplying the gas X to the load side heat medium circuit 120 after the controller 91*a* opens the pressure regulating valve to a predetermined opening degree. Then, the controller 91*a* changed the opening degree of the pressure regulating valve at predetermined time intervals. Thus, in the first replacement step, the supply pressure of the gas X can be varied.

Another method of efficiently discharging the air in the load side heat medium circuit 120 will be described. In the first replacement step, the supply pressure of the gas X may be set so that the average flow velocity of the gas X in the load side heat medium circuit 120 is higher than the diffusion velocity of the air to the gas X. As a method of setting the supply pressure of the gas X, the above-described method using the pressure regulator is only required to be applied. When the average flow velocity of the gas X in the load side heat medium circuit 120 is higher than the diffusion velocity of the air to the gas X, a difference in pressure between the gas supply port 54-2 and the discharge port 54-4 is increased. As a result, the air in the load side heat medium circuit 120 can be easily pushed out of the discharge port 54-4.

In addition, the gas may be caused to flow into the load side heat medium circuit 120 at a pressure higher than the atmospheric pressure. Also in this case, as the pressure at the gas supply port 54-2 is higher than that at the discharge port 54-4, the air in the load side heat medium circuit 120 can be easily pushed out of the discharge port 54-4.

When the inflow velocity of the gas X is increased, the time period required to replace the air with the gas X is reduced. To increase the inflow velocity of the gas X, it is necessary to increase the supply pressure of the gas X. To increase the supply pressure of the gas X, there is the above-described method using the pressure regulator. When the original pressure of the gas X is low, there is a method of increasing the supply pressure of the gas X, using a booster pump. Thus, a configuration for increasing the supply pressure of the gas X is needed. The operator is therefore only required to determine optimum supply pressure and configuration through comparing the time period required to replace the air with the gas X with the difficulty of the configuration for increasing the supply pressure of the gas X.

As both of the air and the gas X are in a gaseous form, in both of the above-described methods in the first replacement step, the surface tension does not act on between the air and the gas X. Consequently, the air in the load side heat medium circuit 120 can be smoothly pushed out of the discharge port 54-4.

Next, the processes in steps S3 and S4 of replacing the gas X with the water will be described. In step S3 shown in FIG. 5, the controller 91*a* controls the gas valve 46 and the heat medium valve 47 to replace the gas X in the load side heat medium circuit 120 with the water. More specifically, the controller 91*a* switches the gas valve 46 from the open state to the closed state and the heat medium valve 47 from the closed state to the open state, to supply the water to the load side heat medium circuit 120. The controller 91*a* determines whether the gas X in the load side heat medium circuit 120 has been replaced with the water (step S4). As a result of the determination, the controller 91*a* continues the supply of the water until a replacement process of replacing the gas X with the water is completed. When the controller 91*a* determines that the replacement process of replacing the gas X with the water has been completed, the process of sealing the water is completed. A step of replacing the gas X in the load side heat medium circuit 120 with the water is referred to as a second replacement step.

In the second replacement step, the water is supplied from the heat medium supply port 54-3 to the load side heat medium circuit 120. The water is stored in the load side heat medium circuit 120 while pushing the gas X from the discharge port 54-4 to the outside. At this time, when the pipe portion higher in height than is the surrounding pipe portion is present as in the bent pipe, the gas X may remain at the pipe portion higher than is the surrounding pipe portion, because of a density difference between the gas X and the water and the surface tension between the gas X and the water. On the other hand, as the gas X is gas having high solubility in the water, the gas X is easily absorbed in the water even when the gas X remains in the pipe. Continuously supplying the water from the gas supply port 54-2 to the load side heat medium circuit 120 therefore enables the gas X in the pipe to be removed.

The amount of water required for replacement in the second replacement step will be considered below. It is necessary to supply, to the inside of the pipe, the minimum amount of water required for pushing out the water containing the gas X, but it is necessary to prevent too much water from being used. Then, the controller 91*a* discharges the gas X from the load side heat medium circuit 120, while the amount of water to be used is kept low as follows.

Firstly, when the amount of water corresponding to the total volume of the pipe of the load side heat medium circuit 120 is supplied to the load side heat medium circuit 120, the controller 91*a* closes the heat medium valve 47. The supply amount of water is calculated by multiplying the supply amount of water per time unit and the supply time period. After the water is sealed in the load side heat medium circuit 120, the controller 91*a* opens the opening-and-closing valve 54-1. Subsequently, the controller 91*a* activates the pump 51 to execute the circulation mode that causes the water to circulate in the load side heat medium circuit 120. Furthermore, the controller 91*a* starts the heating operation in the heat source side refrigerant circuit 110.

When the heating operation is performed in the primary side cycle, the intermediate heat exchanger 5 is heated. The water circulating in the load side heat medium circuit 120 is heated when the water passes through the intermediate heat exchanger 5, whereby the gas X is easily degassed from the water. The gas X is discharged from the discharge port 54-4 every time the heated water passes close to the discharge port 54-4. When the water temperature in the load side heat medium circuit 120 is increased, the dissolution amount of the gas X is decreased, whereby the gas X is discharged from the load side heat medium circuit 120 to the outside. Note that an open valve for discharging the gas X from the pipe may be provided at a portion higher in height than is the surrounding pipe portion in the bent pipe.

When the water pressure is increased, the maximum concentration of the gas X in the water is increased as in Henry's law. Increasing the supply pressure of the water is therefore effective for promoting absorption of the gas X into the water. Alternatively, when the water is supplied, the water flow may be changed. As a method of changing the water flow, there is a method of varying the supply pressure of water. When the water flow is changed, the interface between the water and the gas X is disturbed, whereby the thickness of the concentration boundary layer is reduced. As a result, the absorption of the gas X into the water is promoted. Changing the water flow is therefore effective for promoting absorption of the gas X into the water.

The use of the above-described replacement process including the first replacement step and the second replacement step enables the water to be easily sealed while preventing the amount of air from remaining in the water pipe as small as possible in the water air-conditioning system that is different from the direct expansion system and in which devices made of resin are often used.

Note that in Embodiment 1, a case has been described where the supply port of the gas X and the supply port of the water are individually provided, however, the supply port of the gas X and the supply port of water may be provided in common. A case has been described where the gas X and the water are supplied from the supply port 44 and the gas X is discharged from the discharge port 54-4, but the configuration is not limited to this case. In the second replacement step, the discharge port 54-4 may be used as the supply port of the water, and the supply port 44 may be used as the discharge port of the water and the gas X. In FIG. 1 and FIG. 3, the pipe 45 branches into the gas pipe 45*a* and the heat medium pipe 45*b*, but each of the gas pipe 45*a* and the heat medium pipe 45*b* may be connected directly to the pipe 61.

The operator has performed the work of supplying the tap water directly to some load side heat medium circuit after performing the pipe construction, or the work of supplying the water to the load side heat medium circuit after evacuating the load side heat medium circuit. In contrast, in the method of sealing the heat medium of Embodiment 1, the first replacement step and the second replacement step are performed with the controller 91*a* after the operator performs the pipe construction. In the first replacement step, the air remaining in the pipe of the load side heat medium circuit 120 is replaced with the gas X. In the second replacement step, the gas X sealed in the pipe of the load side heat medium circuit 120 is replaced with the water.

According to the method of sealing the heat medium of Embodiment 1, in the first replacement step, the air in the pipe is replaced with the gas X, and therefore the remaining amount of air in the pipe can be reduced as much as possible when the water is supplied in the second replacement step. Furthermore, in the second replacement step, a large mass such as an air mass can be prevented from being formed in the pipe even when the gas X remains in the pipe. As a result, the flow path resistance due to the gas mass is reduced, and the heat transfer efficiency of the load side heat medium circuit 120 is increased.

When the operator inputs, to the controller 91*a*, the instruction to seal the heat medium in the load side heat medium circuit 120 after the pipe construction, the controller 91*a* controls the heat medium sealing mechanism 54, and performs the replacement process described with reference to FIG. 5. As a result, the heat medium can be sealed in the load side heat medium circuit 120 while the remaining amount of air is reduced as much as possible, and furthermore human errors can be prevented.

In the air-conditioning system 100 of Embodiment 1, the heat medium sealing mechanism 54 in the load side heat medium circuit 120 includes the supply port 44 of the heat medium and the gas X, the discharge port 54-4 of the gas X, and the opening-and-closing valve 54-1 provided between the supply port 44 and the discharge port 54-4.

According to Embodiment 1, to seal the heat medium in the load side heat medium circuit 120, the gas X is supplied from the supply port 44 while pushing out the air in the pipe, and then the heat medium is supplied from the supply port 44 while pushing out the gas X in the pipe. Before the heat medium is sealed in the load side heat medium circuit 120, the gas X is sealed in the pipe while pushing out the air, whereby a large mass such as an air mass can be prevented from being formed in the pipe even when the gas X remains in the pipe. As a result, the flow path resistance due to the gas mass is reduced, and the heat transfer efficiency of the load side heat medium circuit 120 is increased. Furthermore, a failure of the pump and corrosion of the pipe due to a large air mass can be reduced.

In Embodiment 1, it is not necessary to apply a large pressure when the heat medium is sealed in the load side heat medium circuit 120. This is therefore effective for the water air-conditioning system that is different from the direct expansion system and in which devices made of resin are often used. In addition, it is not necessary to provide an air purge valve to the pipe such as a bent pipe in which the air mass is easily formed.

Embodiment 2

An air-conditioning system of Embodiment 2 has a configuration in which a check valve is provided as a backflow prevention device in the load side heat medium circuit 120.

Figure 10:
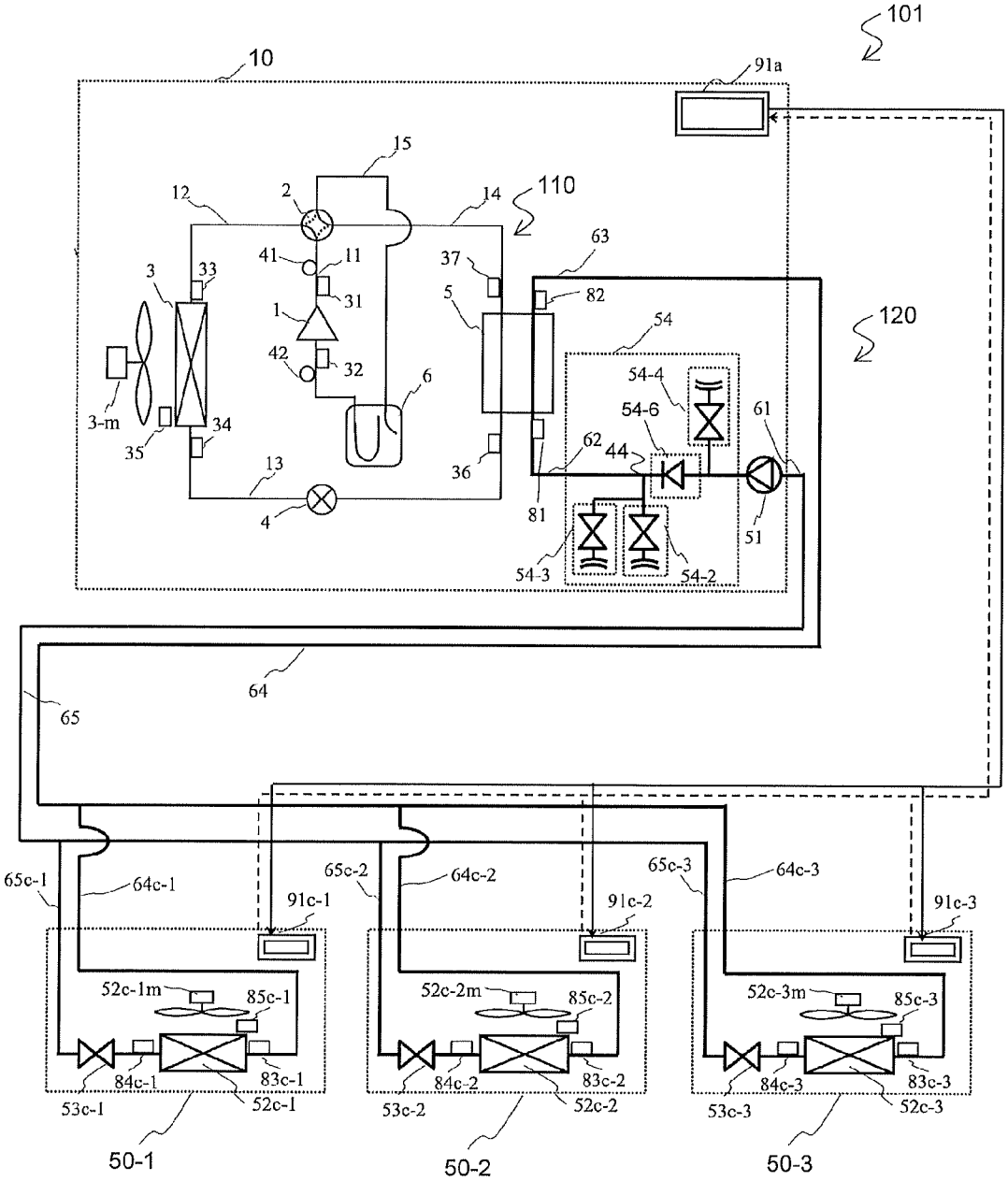
FIG. 10 is a refrigerant circuit diagram illustrating an exemplary configuration of an air-conditioning system according to Embodiment 2 of the present invention.

A configuration of the air-conditioning system of Embodiment 2 will be described. FIG. 10 is a refrigerant circuit diagram illustrating an exemplary configuration of the air-conditioning system according to Embodiment 2 of the present invention. In Embodiment 2, the same configuration as that of Embodiment 1 is not described in detail, and differences between Embodiment 1 and Embodiment 2 will be described in detail.

As illustrated in FIG. 10, the heat medium sealing mechanism 54 in an air-conditioning system 101 includes a check valve 54-6 instead of the opening-and-closing valve 54-1 illustrated in FIG. 1. The check valve 54-6 is a valve that allows the flow in a direction from the discharge port 54-4 to the supply port 44 in the load side heat medium circuit 120, but blocks the flow in a direction from the supply port 44 to the discharge port 54-4. The pump 51 is provided between the heat medium sealing mechanism 54 and the return pipe 65 in the pipe 61.

According to Embodiment 2, the same effects as those obtained in Embodiment 1 can be obtained. In Embodiment 2, the gas X can be prevented from being discharged from the discharge port 54-4 immediately after the gas X enters the pipe from the supply port 44 in the first replacement step, even when the controller 91*a* does not control opening and closing of the opening-and-closing valve 54-1 before the controller 91*a* starts the procedure shown in FIG. 5. In this manner, mistakes of switching opening and closing the opening-and-closing valve 54-1 can be prevented in the replacement work.

Embodiment 3

An air-conditioning system of Embodiment 3 has a configuration in which a gas-liquid separation mechanism is provided as a backflow prevention device in the load side heat medium circuit 120.

Figure 11:
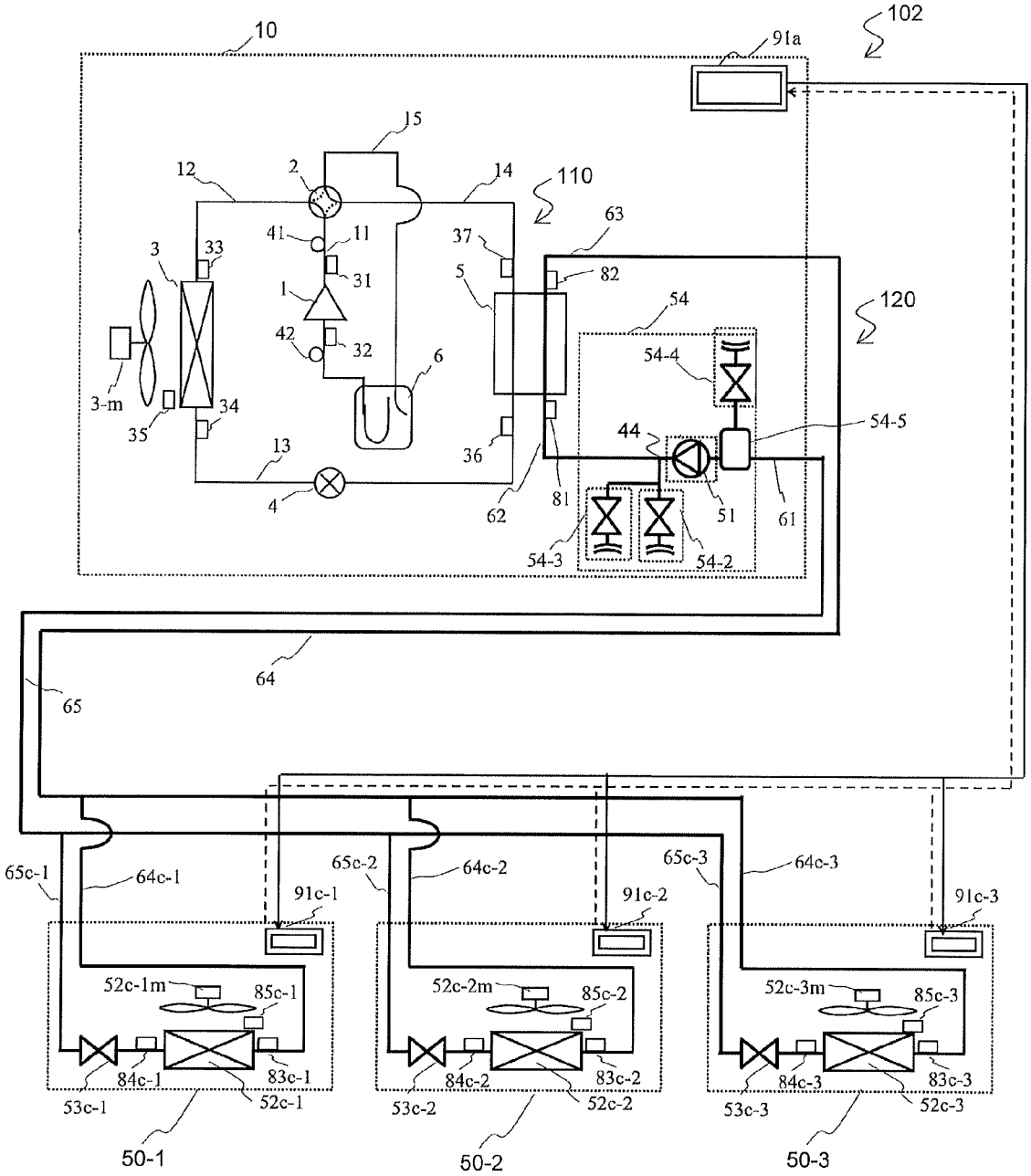
FIG. 11 is a refrigerant circuit diagram illustrating an exemplary configuration of an air-conditioning system according to Embodiment 3 of the present invention.

A configuration of the air-conditioning system of Embodiment 3 will be described. FIG. 11 is a refrigerant circuit diagram illustrating an exemplary configuration of the air-conditioning system according to Embodiment 3 of the present invention. In Embodiment 3, the same configuration as that of Embodiment 1 is not described in detail, and differences between Embodiment 1 and Embodiment 3 will be described in detail.

As illustrated in FIG. 11, the heat medium sealing mechanism 54 in an air-conditioning system 102 includes a gas-liquid separation mechanism 54-5 as a backflow prevention device instead of the opening-and-closing valve 54-1 illustrated in FIG. 1. The gas-liquid separation mechanism 54-5 is a container for separating the gas and the liquid. The gas-liquid separation mechanism 54-5 is provided in the pipe 61. The discharge port 54-4 is connected to the pipe 61 through the gas-liquid separation mechanism 54-5. The pump 51 is provided between the supply port 44 and the gas-liquid separation mechanism 54-5.

In Embodiment 3, in the circulation mode, when the heat medium returning from the load side units 50-1 to 50-3 enters the gas-liquid separation mechanism 54-5, the gas X is separated from the heat medium, and discharged from the discharge port 54-4. Even when the air remains in the heat medium, the air is separated from the heat medium by the gas-liquid separation mechanism 54-5, and is discharged from the discharge port 54-4.

Note that in Embodiment 3, a heating device may be provided to the gas-liquid separation mechanism 54-5. In this case, in the second replacement step in steps S3 to S4 shown in FIG. 5, the heating device can heat and gasify the gas X dissolved in the heat medium, and the gas X can be discharged from the discharge port 54-4 to the outside.

Embodiment 4

An air-conditioning system of Embodiment 4 has a configuration in which a relay device is provided between the heat source unit 10 and the load side units 50-1 to 50-3.

Figure 12:
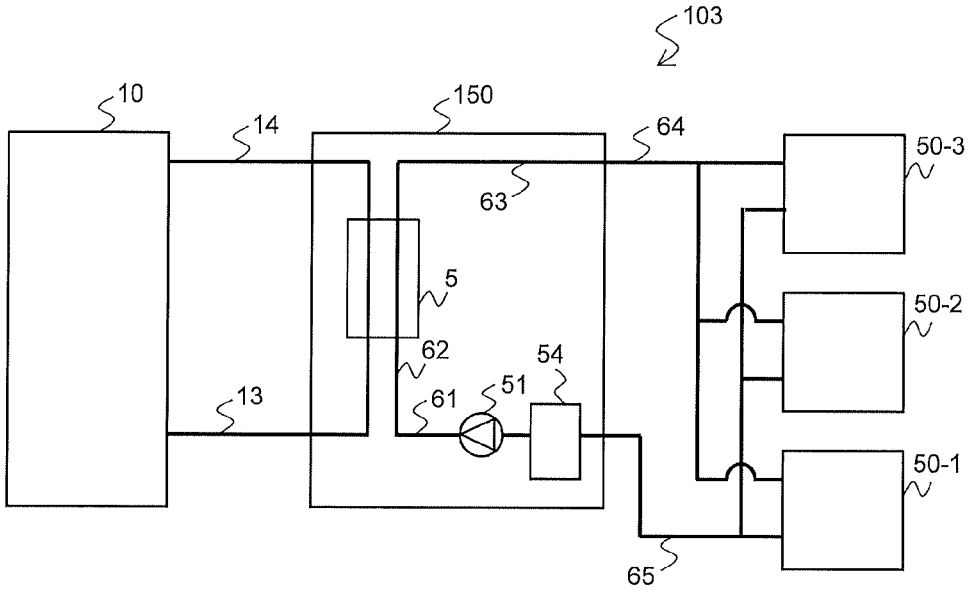
FIG. 12 is a diagram illustrating an exemplary configuration of an air-conditioning system according to Embodiment 4 of the present invention.

A configuration of the air-conditioning system of Embodiment 4 will be described. FIG. 12 is a diagram illustrating an exemplary configuration of the air-conditioning system according to Embodiment 4 of the present invention. In Embodiment 4, the same configuration as that of Embodiment 1 is not described in detail, and differences between Embodiment 1 and Embodiment 4 will be described in detail.

As illustrated in FIG. 12, an air-conditioning system 103 includes a relay device 150. The relay device 150 is provided between the heat source unit 10 and the load side units 50-1 to 50-3. The relay device 150 includes the intermediate heat exchanger 5, the heat medium sealing mechanism 54, the pump 51, and the pipes 61 to 63. The relay device 150 is placed closer to the load side units 50-1 to 50-3 than is the heat source unit 10. As compared with a configuration described in Embodiment 1, a distance between the relay device 150 and the load side units 50-1 to 50-3 in Embodiment 4 is shorter than that in Embodiment 1, whereby the lengths of the supply pipe 64 and the return pipe 65 are shorter than those in Embodiment 1.

Note that FIG. 12 illustrates relevant parts of the configuration illustrated in FIG. 1, and a part of the configuration is not illustrated in FIG. 12. The thermometers 36, 37, 81, and 82 illustrated in FIG. 1 are not illustrated in FIG. 12.

With the above-described configuration, the air-conditioning system 103 of Embodiment 4 transfers heat from the heat source unit 10 to the relay device 150 using the refrigerant, the refrigerant is subjected to heat exchange with the water through the relay device 150, and the heat is transferred to the load side units 50-1 to 50-3 using the water subjected to heat exchange with the refrigerant.

In Embodiment 4, an amount of heat medium to be sealed in the load side heat medium circuit 120 can be reduced, as compared with that in Embodiment 1. As a result, the remaining amount of air and the gas X in the load side heat medium circuit 120 can be reduced. A necessary amount of heat medium can be reduced, and the volume of the expansion tank for storing the heat medium can be reduced when the density of the heat medium is changed as the temperature of the heat medium changes.

In Embodiments 1 to 4, a case has been described where the number of load side units is three, but the number of load side units is not limited to three. In addition, a case has been described where the number of intermediate heat exchangers 5 is one, but the number of intermediate heat exchangers 5 is not limited to one. As long as the heat medium can be cooled and heated, a plurality of intermediate heat exchangers 5 may be provided.

Figure 13:
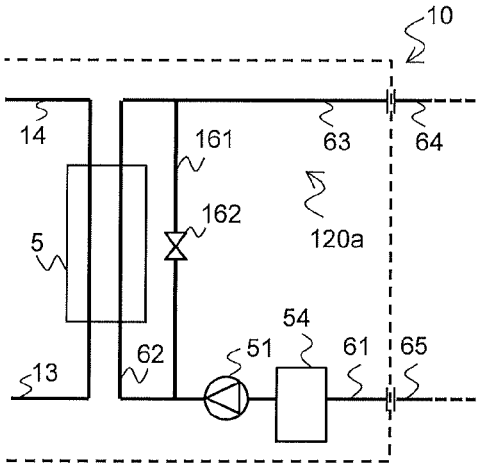
FIG. 13 is a diagram illustrating another example of a load side heat medium circuit in a heat source unit illustrated in FIG. 1.

In Embodiments 1 to 4, a case has been described where the backflow prevention device is used to make the flow of the gas X and heat medium in a single direction so that the gas X and heat medium flow from the supply port 44 through the intermediate heat exchanger 5 and are discharged from the discharge port 54-4, but the flow path in which the heat medium is sealed is not limited to this case. FIG. 13 is a diagram illustrating another example of a load side heat medium circuit in a heat source unit illustrated in FIG. 1. The configuration of the heat source side refrigerant circuit 110 is not illustrated in FIG. 13. In the load side heat medium circuit 120*a* illustrated in FIG. 13, a bypass 161 is provided in parallel to the intermediate heat exchanger 5. A valve 162 for regulating the capacity is provided in the bypass 161. The valve 162 is used to adjust the load by controlling the opening degree when the capacity becomes excessive. In the configuration illustrated in FIG. 13, the heat medium is also sealed in the bypass 161. The backflow prevention device is only required to include a function as a flow straightener that is connected to the load side heat medium circuit 120*a* in such a manner that, when the gas X is supplied, the gas X flows from the supply port 44 to the discharge port 54-4, and when the heat medium is supplied, the heat medium flows from the supply port 44 to the discharge port 54-4.

The invention claimed is:

1. An air-conditioning system, comprising:

a heat source side refrigerant circuit in which a heat source side heat exchanger is provided;

a load side heat medium circuit in which a load side heat exchanger is provided;

an intermediate heat exchanger configured to exchange heat between the heat source side refrigerant circuit and the load side heat medium circuit; and a heat medium sealing mechanism that is provided in the load side heat medium circuit and at which a heat medium is supplied to the load side heat medium circuit, the heat medium sealing mechanism located on a return pipe between the load side heat exchanger and the intermediate heat exchanger, including a supply port that is connected to the load side heat medium circuit and through which the heat medium and gas flow, the gas being more soluble in the heat medium than is air, a discharge port that is connected to the load side heat medium circuit and through which the gas pushed by the heat medium is discharged, and a flow straightener that is connected to the load side heat medium circuit in such a manner that, when the gas is supplied, the gas flows from the supply port to the discharge port, and when the heat medium is supplied, the heat medium flows from the supply port to the discharge port.

2. The air-conditioning system of claim 1, wherein the flow straightener is provided in a part of the load side heat medium circuit that is between the supply port and the discharge port, the flow straightener being configured to prevent the gas and the heat medium from flowing out of the supply port to the discharge port without flowing through the intermediate heat exchanger from the supply port.

3. The air-conditioning system of claim 2, wherein the flow straightener comprises a gas-liquid separation mechanism that is configured to separate the gas from the heat medium and discharge the separated gas from the discharge port.

4. The air-conditioning system of claim 1, wherein the gas is carbon dioxide.

5. An air-conditioning system, comprising:

a heat source side refrigerant circuit in which a heat source side heat exchanger is provided;

a load side heat medium circuit in which a load side heat exchanger is provided;

an intermediate heat exchanger configured to exchange heat between the heat source side refrigerant circuit and the load side heat medium circuit;

a heat medium sealing mechanism that is provided in the load side heat medium circuit and at which a heat medium is supplied to the load side heat medium circuit;

the heat medium sealing mechanism including a supply port that is connected to the load side heat medium circuit and through which the heat medium and gas flow, the gas being more soluble in the heat medium than is air, a discharge port that is connected to the load side heat medium circuit and through which the gas pushed by the heat medium is discharged, and a flow straightener that is connected to the load side heat medium circuit in such a manner that, when the gas is supplied, the gas flows from the supply port to the discharge port, and when the heat medium is supplied, the heat medium flows from the supply port to the discharge port, the air-conditioning system further comprising a gas pipe to which the gas is supplied, the gas pipe being used as the supply port;

a heat medium pipe to which the heat medium is supplied, the heat medium pipe being used as the supply port;

a gas valve provided in the gas pipe;

a heat medium valve provided in the heat medium pipe; and a controller connected to the gas valve and the heat medium valve by a signal line, the controller being configured to control opening and closing of the gas valve and the heat medium valve, wherein the controller is configured to cause the gas valve to be in an open state to supply the gas to the load side heat medium circuit until the gas is discharged from the discharge port, switch the gas valve from the open state to a closed state and cause the heat medium valve to be in an open state when the gas is sealed in the load side heat medium circuit, to supply the heat medium to the load side heat medium circuit, and switch the heat medium valve from the open state to a closed state when the heat medium is sealed in the load side heat medium circuit.

6. The air-conditioning system of claim 5, further comprising a plurality of load side units connected in the load side heat medium circuit in parallel and provided with a plurality of the load side heat exchangers, wherein each of the plurality of load side units includes the load side heat exchanger and a flow control valve configured to control a flow rate of the gas flowing into the load side heat exchanger, and the controller is configured to cause a plurality of the flow control valves to be in an open state when the gas is supplied to the load side heat medium circuit.

7. The air-conditioning system of claim 6, wherein the controller is configured to adjust an opening degree of each of the plurality of the flow control valves in such a manner that a difference in time period from a start time of supply of the gas to the load side heat medium circuit to a corresponding arrival time at which the gas branching into the plurality of the load side heat exchangers returns to a return pipe of the load side heat medium circuit is within a predetermined range.

8. The air-conditioning system of claim 5, wherein the flow straightener is provided in a part of the load side heat medium circuit that is between the supply port and the discharge port, the flow straightener being configured to prevent the gas and the heat medium from flowing out of the supply port to the discharge port without flowing through the intermediate heat exchanger from the supply port.

9. The air-conditioning system of claim 8, wherein the flow straightener comprises a gas-liquid separation mechanism that is configured to separate the gas from the heat medium and discharge the separated gas from the discharge port.

10. The air-conditioning system of claim 5, wherein the gas is carbon dioxide.

11. A method of sealing a heat medium in a load side heat medium circuit in an air-conditioning system including a heat source side refrigerant circuit including a heat source side heat exchanger; the load side heat medium circuit including a load side heat exchanger, a supply port, a discharge port, and a flow straightener provided between the supply port and the discharge port; and an intermediate heat exchanger configured to exchange heat between the heat source side refrigerant circuit and the load side heat medium circuit, the supply port, the discharge port, and the flow straightener located on a return pipe between the load side heat exchanger and the intermediate heat exchanger, the method comprising:

a first replacement step in which gas that is more soluble in the heat medium than is air is supplied from the supply port to the load side heat medium circuit and discharged from the discharge port until the gas is sealed in the load side heat medium circuit; and a second replacement step in which, when the gas is sealed in the load side heat medium circuit, the heat medium is supplied from the supply port to the load side heat medium circuit until the heat medium is sealed in the load side heat medium circuit.

12. The method of sealing a heat medium of claim 11, wherein, the first replacement step further comprises supplying the gas from the supply port to the load side heat medium circuit at a pressure higher than an atmospheric pressure.

13. The method of sealing a heat medium of claim 11, wherein, the first replacement step further comprises supplying the gas from the supply port to the load side heat medium circuit in such a manner that an average flow velocity of the gas in the load side heat medium circuit is higher than a diffusion velocity of air to the gas.

14. The method of sealing a heat medium of claim 11, wherein, the first replacement step further comprises supplying the gas from the supply port to the load side heat medium circuit such that a supply pressure of the gas varies.

15. The method of sealing a heat medium of claim 11, wherein, in the second replacement step, when a heating operation is performed in the heat source side refrigerant circuit, the heat medium is degassed from the load side heat medium circuit.

* * * * *